US008834327B1

(12) United States Patent
George, Jr.

(10) Patent No.: US 8,834,327 B1
(45) Date of Patent: Sep. 16, 2014

(54) STATIONARY EXERCISE APPARATUS

(76) Inventor: Victor I. George, Jr., Brooklyn, NY (US)

( * ) Notice: Subject to any disclaimer, the term of this patent is extended or adjusted under 35 U.S.C. 154(b) by 315 days.

(21) Appl. No.: 13/303,692

(22) Filed: Nov. 23, 2011

(51) Int. Cl.
*A63B 21/068* (2006.01)
*A63B 26/00* (2006.01)

(52) U.S. Cl.
USPC ..... 482/96; 482/141; 482/142

(58) Field of Classification Search
USPC ..... 482/35–38, 40, 44–50, 91–104, 482/141–142; D21/662, 684, 686
See application file for complete search history.

(56) References Cited

U.S. PATENT DOCUMENTS

| | | | | |
|---|---|---|---|---|
| 1,410,149 | A | 3/1922 | Williams et al. | |
| D267,419 | S | 12/1982 | Komarnicki | |
| D290,033 | S | 5/1987 | Policastro | |
| 4,696,470 | A | 9/1987 | Fenner | |
| 4,923,194 | A | 5/1990 | Montgomery | |
| 5,050,868 | A * | 9/1991 | Pearson | 482/94 |
| 5,100,128 | A * | 3/1992 | Mabry et al. | 482/134 |
| 5,389,055 | A | 2/1995 | Gangloff | |
| 6,743,152 | B2 | 6/2004 | Weiss | |
| 7,104,939 | B1 * | 9/2006 | Martinez | 482/142 |
| 7,608,029 | B2 * | 10/2009 | Weiss et al. | 482/142 |
| 2004/0110608 | A1 | 6/2004 | Washington | |
| 2006/0287170 | A1 * | 12/2006 | Gerschefske et al. | 482/94 |
| 2009/0069161 | A1 * | 3/2009 | Caldwell | 482/138 |

* cited by examiner

*Primary Examiner* — Loan H Thanh
*Assistant Examiner* — Jennifer M Deichl
(74) *Attorney, Agent, or Firm* — Robert C. Montgomery; Montgomery Patent & Design

(57) ABSTRACT

A stationary exercise apparatus includes features for performing a variety of exercises including pull-ups, dips, push-ups, squats, crunches, and leg raises. The apparatus includes a frame, a horizontal bar, a plurality of handles, and a floor mat. The frame includes a pair of vertical uprights extending upward from a flat base and provides an attachment support to the horizontal bar at a top end. The frame also includes a plurality of pairs of handles which provide grasping members for the operator to use during various types of exercises. The apparatus includes an open area between the frames to receive the floor mat for performing floor-based exercises.

11 Claims, 6 Drawing Sheets

STATIONARY EXERCISE APPARATUS

RELATED APPLICATIONS

Not Applicable.

FIELD OF THE INVENTION

The present invention relates generally to exercise equipment, and in particular, to stationary exercise apparatus for performing various body weight exercises on a single piece of equipment.

BACKGROUND OF THE INVENTION

Physical fitness and improved health are among the areas of highest concern and popularity in people today. More than ever, people are frequenting health clubs and performing exercise routines at home in order to lose weight, improve muscle tone, and maintain a healthy lifestyle. Often such workouts are intended for general body strengthening or rehabilitation after surgery. Whatever the reason, there are literally thousands of different machines designed to strengthen and improve various muscle groups. Such machines strengthen arm and chest areas, while others concentrate on biceps and triceps areas, and yet others concentrate on back and shoulder areas.

While these various machines may achieve their particular objectives, each suffers from at least one (1) disadvantage and deficiency based on design, function, or utilization. Particularly, most of the weight machines are large, bulky, and heavy; making them almost impossible to move. Other machines which utilize the body weight of the users are flimsy and prone to malfunction or failure. Additionally, these machines typically limit the type of exercises performed to those for which the machine was specifically designed for, which requires numerous machines for a total body workout.

SUMMARY OF THE INVENTION

The inventor has recognized the aforementioned inherent problems and lack in the art and observed that there is a need for exercise equipment which maximizes workouts, provides such workouts for a maximum number of body parts, and limits the number of machines needed for such workouts.

Accordingly, it is an object of the present embodiments of the invention to solve at least one (1) of these problems. The inventor has addressed this need by developing a stationary full-body exercise apparatus that provides users the capability to perform total body exercises at virtually any location in a manner which is quick, easy, and effective, while being performed with a minimal amount of equipment that is easily portable.

The inventor has thus realized the advantages and benefits of providing an exercise apparatus having generally having a first frame, a second frame, and a rear base.

The first frame includes a generally rectangular first base adapted to lay flat on a floor surface and a generally "L"-shaped first upright affixed to a top surface of the first base. A first lower front handle is affixed between the top surface of the first base and a lower end of the first upright. A first upper front handle is affixed to a side of an upper end of the first upright. A first upper rear handle is affixed to an opposing side of the upper end of the first upright.

The second frame includes a generally rectangular second base adapted to lay flat on said floor surface and a generally "L"-shaped second upright affixed to a top surface of the second base. A second lower front handle is affixed between the top surface of the second base and a lower end of the second upright. A second upper front handle is affixed to a side of an upper end of the second upright. A second upper rear handle is affixed to an opposing side of the upper end of said second upright.

The rectangular rear base is adapted to lay flat on the floor surface and is attachable between the first frame and the second frame such that the first frame is spaced apart from and is parallel to the second frame defining an open area. The rear base includes a rear handle affixed to a top surface. A cross bar is supported horizontally between the upper end of the first upright and the upper end of said second upright.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
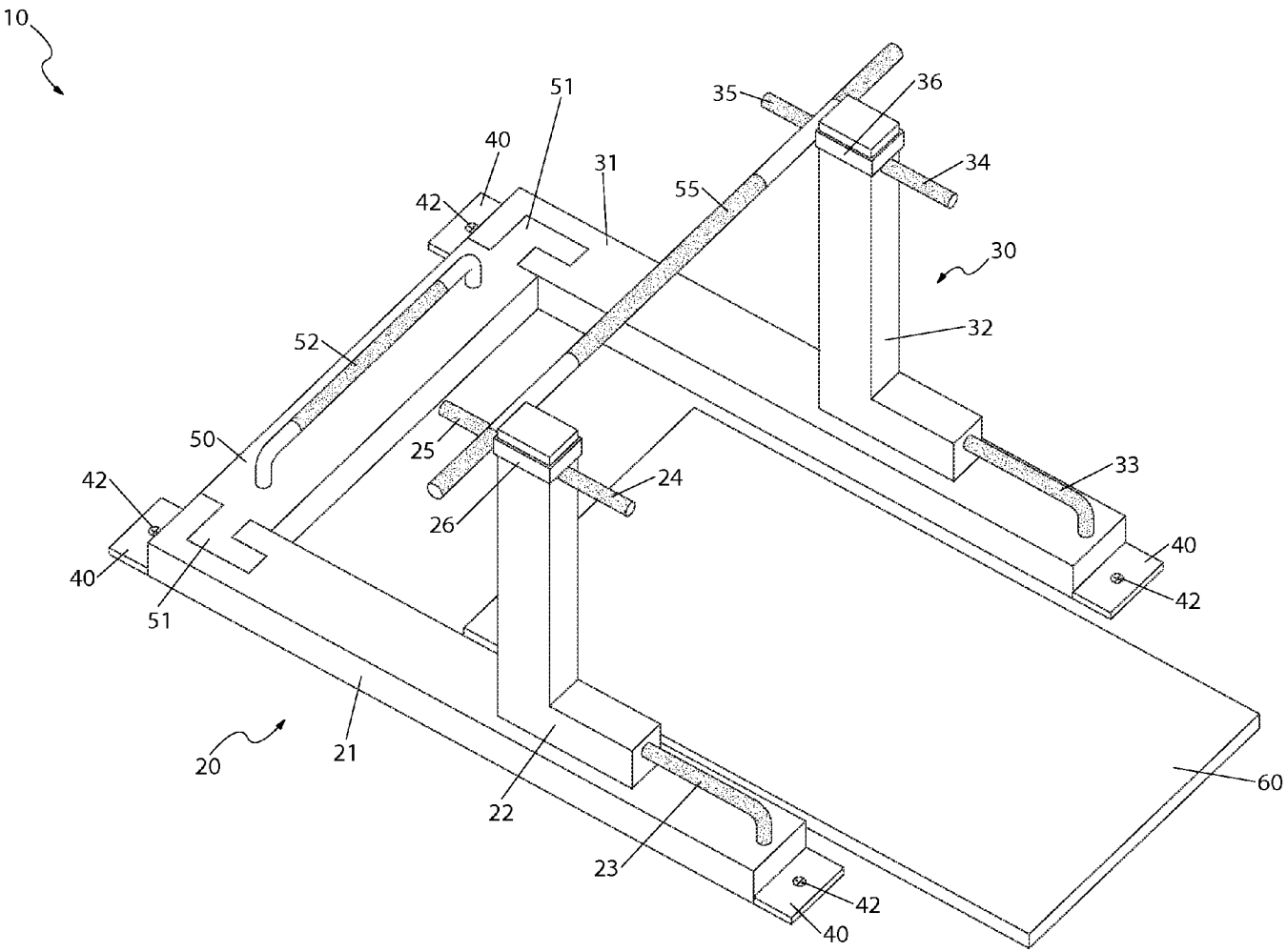
FIG. 1 is a perspective view of a stationary full-body exercise apparatus in accordance with the present invention.

10 stationary full-body exercise apparatus
11 operator
20 first frame structure
21 first base member
22 first upright
23 first lower front handle
24 first upper front handle
25 first upper rear handle
26 first protective collar
27 first receiving slot
30 second frame structure
31 second base member
32 second upright
33 second lower front handle
34 second upper front handle
35 second upper rear handle
36 second protective collar
37 second receiving slot
40 mounting ear
41 aperture
42 fastener
50 rear base member

51 interlocking member
52 rear handle
55 cross bar
60 mat

DETAILED DESCRIPTION OF THE PREFERRED EMBODIMENT

In accordance with the invention, the best mode is presented in terms of a preferred embodiment, herein depicted within FIGS. 1 through 6. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Referring now to FIGS. 1 through 4, depicting a stationary full-body exercise apparatus (herein described as an "apparatus") 10, where like reference numerals represent similar or like parts. In accordance with the invention, the present disclosure describes the apparatus 10 for increasing physical fitness and promoting a healthier lifestyle of an operator 11. The apparatus 10 allows the operator 11 to perform various strengthening exercises with a single machine that targets various body parts to maximize the workout and reduces the workout time and number of workout equipment needed.

FIG. 1 shows a perspective view of view of the apparatus 10. The apparatus 10 generally includes an interlocking frame having a first frame structure 20, a second frame structure 30, and a rear base member 50, all of which allow the operator 11 to perform various different targeted strength building exercises. The first frame structure 20 opposes the second frame structure 30 and each is stabilized by the rear base member 50. The apparatus 10 also includes a plurality of handles 23, 24, 25, 33, 34, 35, 52 to provide the operator 11 with a gripping surface during the various selected exercises. The first frame structure 20, the second frame structure 30, and the rear base member 50 are fabricated from a strong and durable material, such as steel, yet other materials can be utilized without limiting the scope of the invention.

The apparatus 10 also includes a removable mat 60 which provides a padded surface placed on a generally level surface near the operator 11 during certain exercises for comfort. The mat 60 is placed between the first frame structure 20 and the second frame structure 30 for illustration purposes and it is can be appreciated that other positions can be utilized without limiting the scope of the invention. The mat 60 measures approximately twenty-three (23) inches in width and thirty-six (36) inches in length and is fabricated from a rubber, vinyl cover foam, or similar material which promotes comfort and durability.

Figure 2:
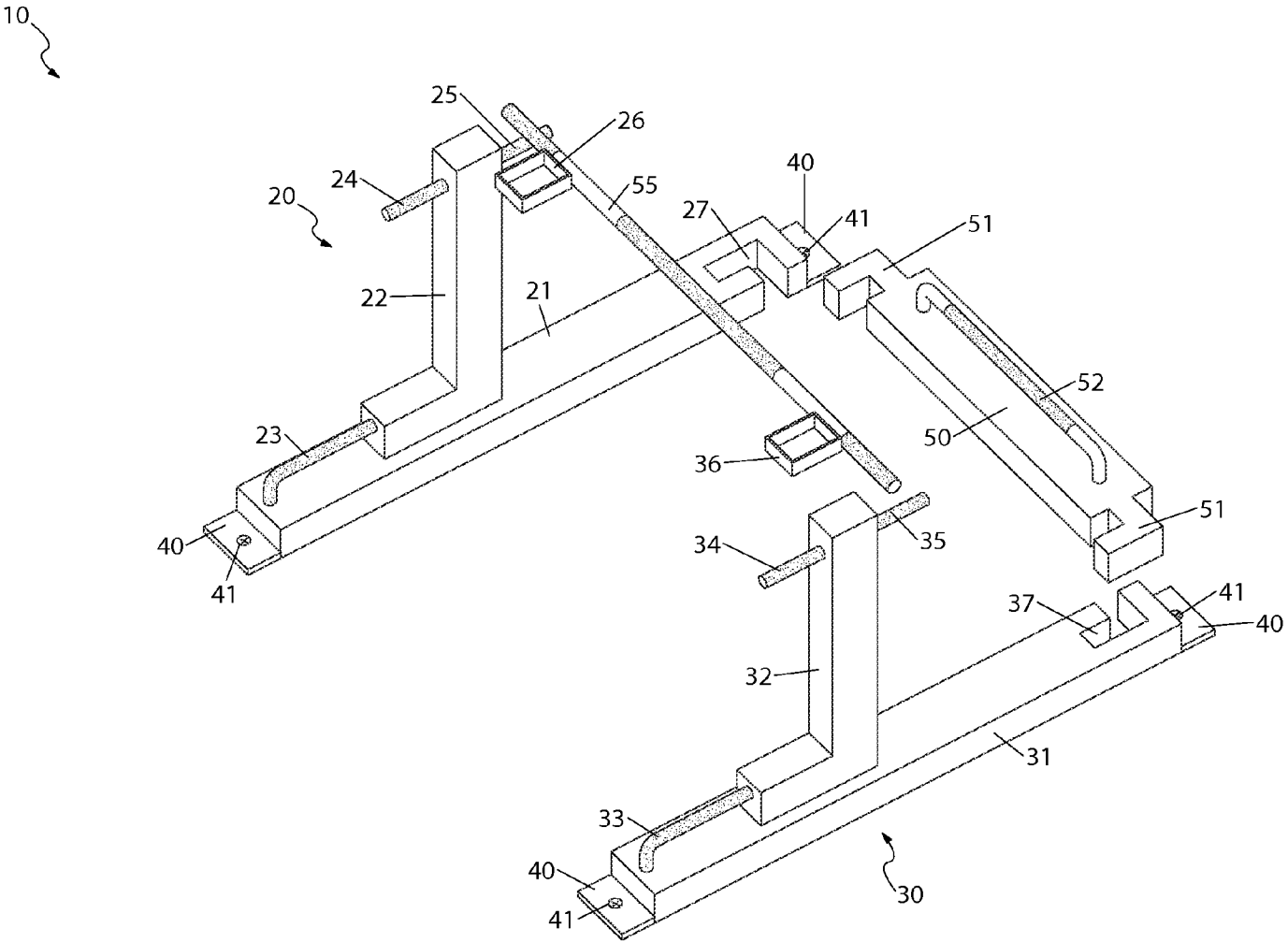
FIG. 2 is an opposing perspective exploded view of the stationary full-body exercise apparatus.

FIG. 2 shows an exploded perspective view of the apparatus 10 from a vantage opposite of FIG. 1. The first frame structure 20, the second frame structure 30, and the rear base member 50 are connected together and work in conjunction to form a sturdy, unitary exercise structure for use by the operator 11. The exercise structures 20, 30 and rear base member 50 are attachable to provide for simple disassembly for storage purposes. The first frame structure and second frame structure 30 are mirror images of each other having identical features to provide the operator 11 symmetry during use.

The first frame structure 20 includes a first base member 21 for contact with the ground surface and providing a sturdy base for the apparatus 10. The first base member 21 measures approximately three (3) inches in width and thirty-six (36) inches in length. Each opposing end of the first base member 21 includes a mounting ear 40 which has an aperture 41 to accept a fastener 42 for securing the first frame structure 20 to the support surface to prevent movement of the apparatus 10 during use. A proximal end portion of the first base member 21 also includes a first receiving slot 27 which interlockingly receives an end of the rear base member 50. An "L"-shaped first upright 22 is perpendicularly affixed to an upper surface of the first base member 21. The first upright 22 measures approximately forty (40) inches in height. The first upright 22 is preferably welded onto the first base member 21, yet other attachment methods can be utilized without equal benefit.

A generally "L"-shaped first lower front handle 23 is attached between a lower front portion of the first upright 22 and the upper surface of the first base member 21. The first lower front handle 23 provides a gripping surface for the operator 11 to grasp during certain exercises. The exterior surface of the first lower front handle 23 can include knurled ridges which increase the user's grip comfort.

A linear first upper front handle 24 and a linear first upper rear handle 25 extend outwardly from opposing sides of an upper vertical portion of the first upright 22. The upper front and rear handles 24, 25 provide additional gripping surfaces for certain other exercises or provide a positioning and support surface for a cross bar 55. The first upper front handle 24 is positioned upon a front upper surface of the first upright 22 and the first upper rear handle 25 is positioned upon a rear upper surface of the first upright 22 aligned with the first upper front handle 24, both upper front and rear handles 24, 25 being parallel to the first base member 21. An exterior surface of the first upper front handle 24 and first upper rear handle 25 also include knurled ridges which increase the user's grip comfort. The first handles 23, 24, 25 are attached by welding, however it can be appreciated that other attachment methods can be utilized.

The second frame structure 30 includes a second base member 31 for contact with the ground surface parallel to the first base member and providing a sturdy base for the apparatus 10. The second base member 31 measures approximately three (3) inches in width and thirty-six (36) inches in length. Each opposing end of the second base member 31 includes a mounting ear 40 having an aperture 41 to accept a fastener 42 for securing the second frame structure 30 to the ground surface to prevent movement of the apparatus 10 during use. A proximal end portion of the second base member 31 includes a second receiving slot 37 which interlockingly receives the rear base member 50. An "L"-shaped second upright 32 is perpendicularly affixed to an upper front surface of the second base member 31. The second upright 32 measures approximately forty (40) inches in height. The second upright 32 is preferably welded onto the second base member 31, yet other methods can be utilized with equal benefit.

A generally "L"-shaped second lower front handle 33 is attached between a lower front portion of the second upright 32 and the upper surface of the second base member 31. The second lower front handle 33 provides a gripping surface for the operator 11 to grasp during certain exercises. The exterior surface of the second lower front handle 33 can include knurled ridges which increase the user's grip comfort.

A linear second upper front handle 34 and a linear second upper rear handle 35 extend outwardly from opposing sides of an upper vertical portion of the second upright 32. The upper front and rear handles 34, 35 provide additional gripping surfaces for certain other exercises or provide a positioning and support surface for the cross bar 55. The second upper front handle 34 is positioned upon a front upper surface of the second upright 32 and the second upper rear handle 35 is positioned upon a rear upper surface of the second upright 32 aligned with the second upper front handle 24, both second upper front and rear handles 34, 35 being parallel to the second base member 31. An exterior surface of the second upper front handle 34 and second upper rear handle 35 also include knurled ridges which increase the user's grip comfort. The second handles 33, 34, 35 are attached by welding, however it can be appreciated that other attachment methods can be utilized.

The rear base member 50 interlocks between the first frame structure 20 and the second frame structure 30 and secures the apparatus 10 in a stable position. The rear base member 50 separates the first base member 21 from the second base member 31 by approximately twenty-four (24) inches. The twenty-four (24) inch space is utilized by the operator 11 during exercising. Opposing ends of the rear base member 50 include integral interlocking members 51 which engagingly mate to a respective receiving slot 27, 37 to connect the apparatus 10. An upper surface of the rear base member 50 includes a rear handle 52 having a generally elongated, inverted "U"-shape and a knurled ridge on an exterior surface which increases the user's grip comfort. The rear handle 52 is attached to the rear base member 50 by welding, however other attachment methods can be utilized with equal benefit.

The apparatus 10 also includes a mountable cross bar 55 which provides the operator 11 a graspable surface to suspend from while performing certain other exercises. The cross bar 55 is a rigid, elongated rod which measures approximately thirty (30) inches in length with a diameter suitable for the operator 11 to grip. The cross bar 55 is positionable and supportable across an upper surface of the upper front handles 24, 34 or upper rear handles 25, 35. The exterior surface of the cross bar 55 can include knurled ridges which increase the user's grip comfort.

A first protective collar 26 is affixed to an end portion of the cross bar 50 and encompasses over the upper exterior surface of the first upright 22 to secure the cross bar 50 to the first frame structure 20 during use. The first protective collar 26 rests upon the upper surfaces of the first upper front handle 24 and rear handle 25. The first protective collar 26 is a durable rubber or metal material which prevents marring due to movements against the surface of the first upright 22. An exterior surface of the first protective collar 26 is attached by welding to the cross bar 55 to secure in position when utilized on the apparatus 10 and is easily removed.

A second protective collar 36 is affixed to an opposing end portion of the cross bar 50 and encompasses over the upper exterior surface of the second upright 32 to secure the cross bar 50 to the second frame structure 30 during use. The second protective collar 36 rests upon the upper surfaces of the second upper front handle 34 and rear handle 35. The second protective collar 36 is a durable rubber or metal material which prevents marring due to movements against the surface of the second upright 32. An exterior surface of the second protective collar 36 is attached by welding to the cross bar 55 to secure in position when utilized on the apparatus 10 and is easily removed.

Figure 3:
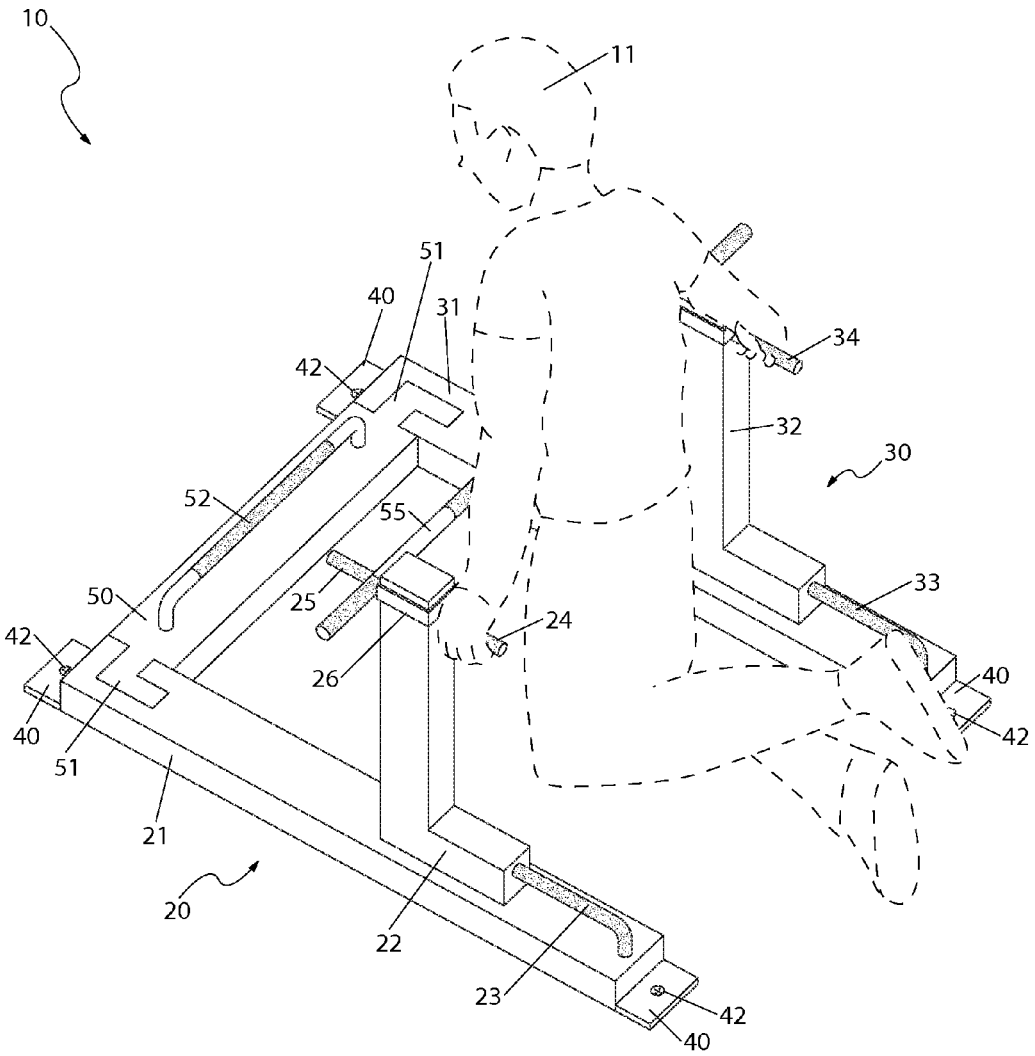
FIG. 3 is an in-use perspective view of the stationary full-body exercise apparatus.
Figure 4:
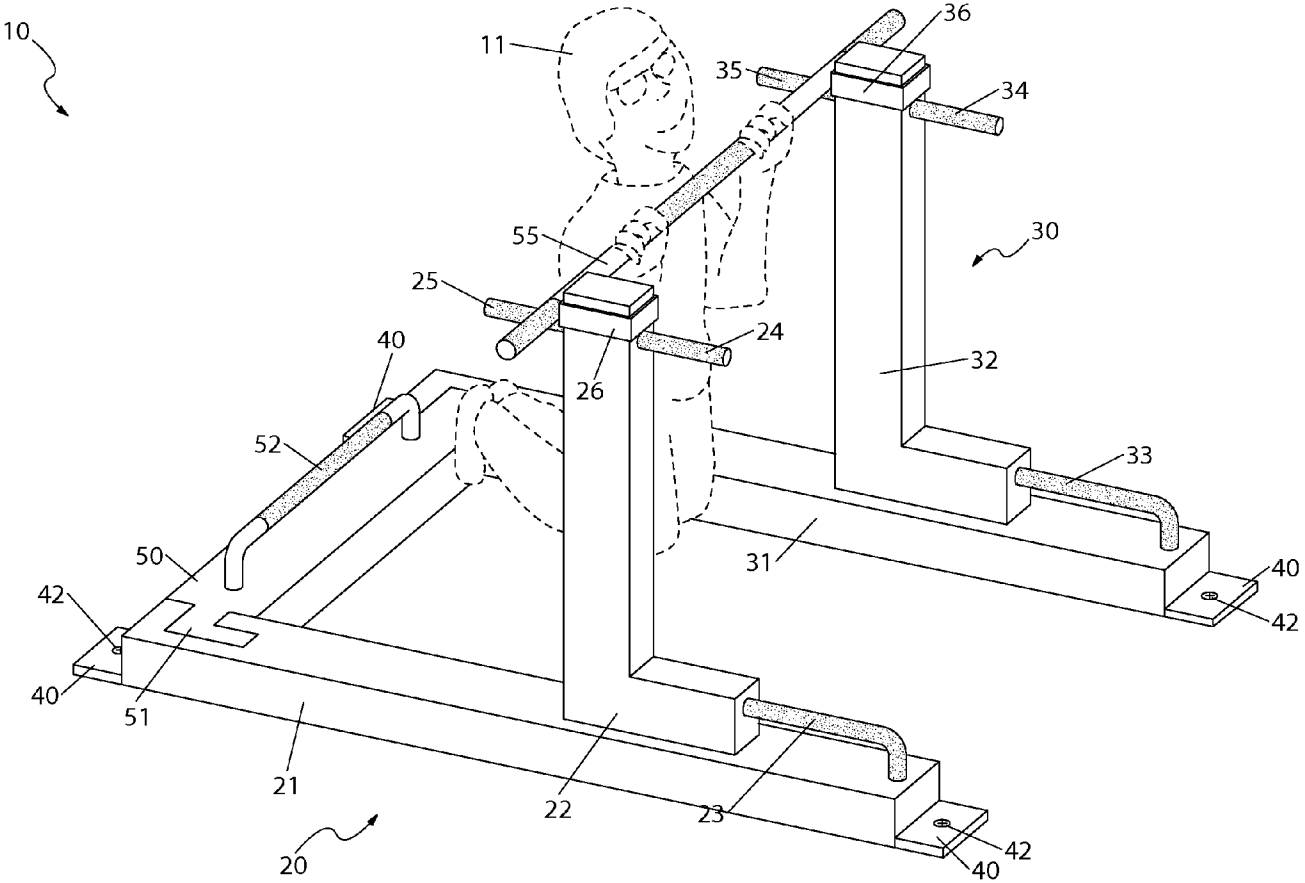
FIG. 4 is in-use perspective view of the stationary full-body exercise apparatus.
Figure 5:
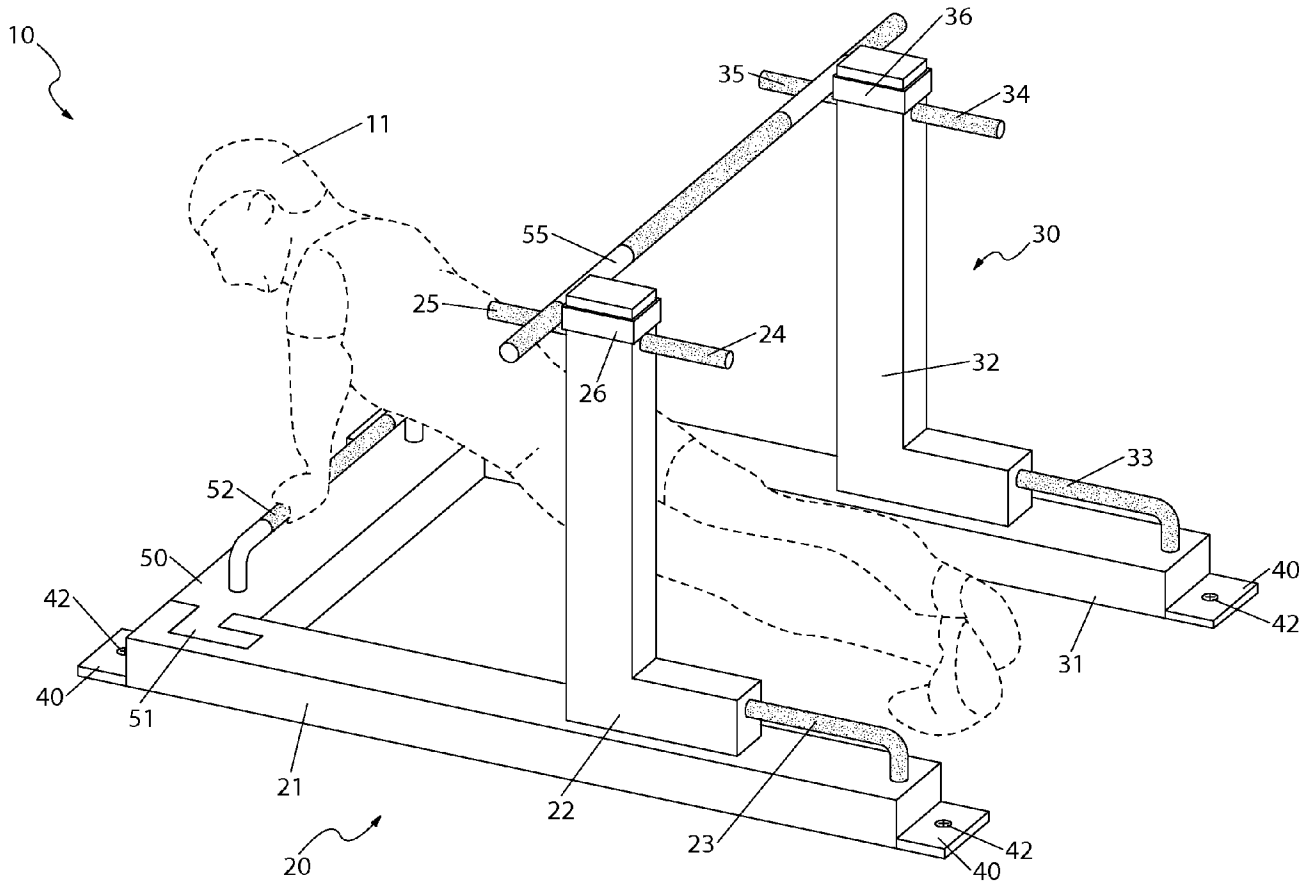
FIG. 5 is an in-use perspective view of the stationary full-body exercise apparatus; and, FIG. 6 is an in-use perspective view of the stationary full-body exercise apparatus.
Figure 6:
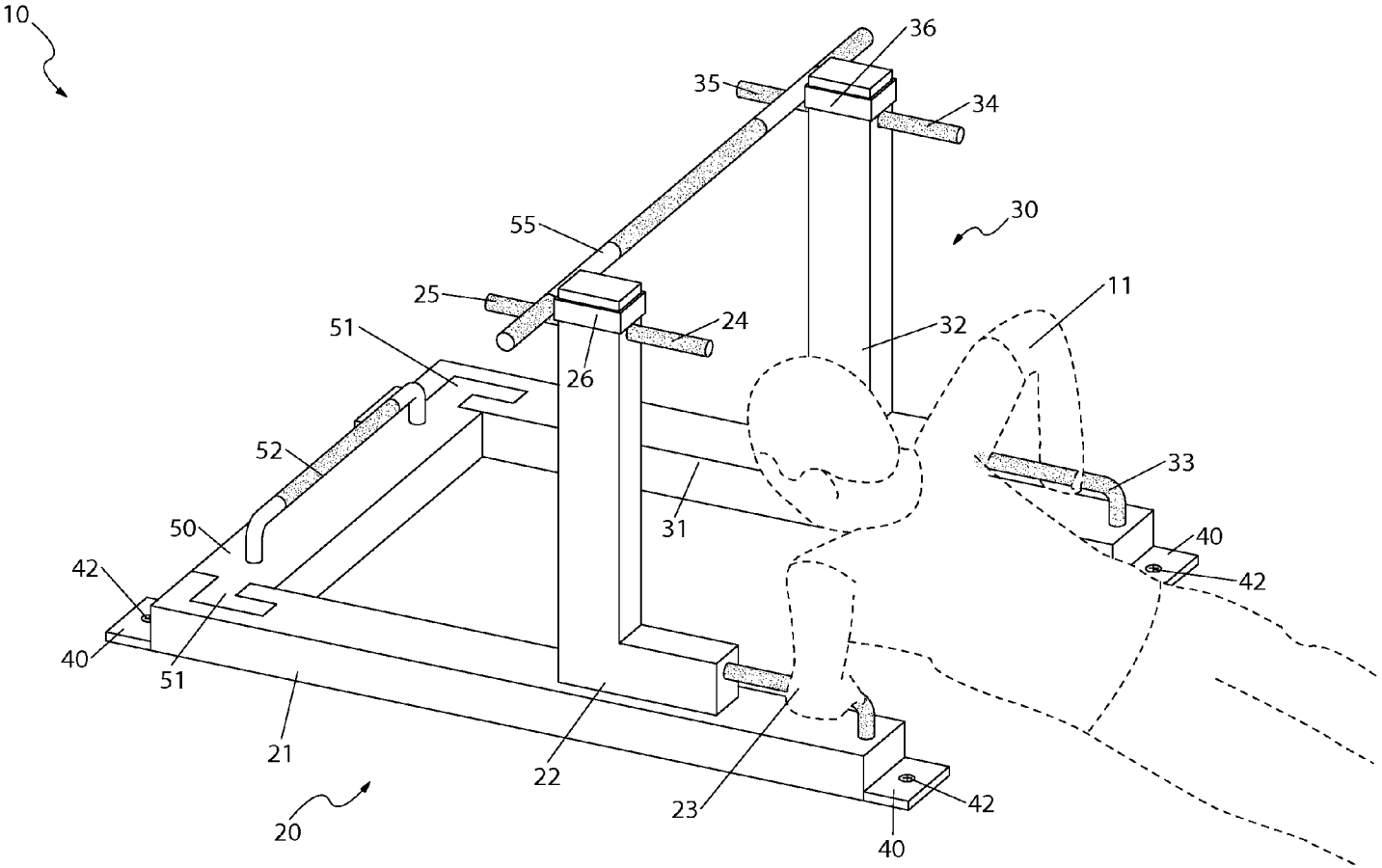

Referring now to FIGS. 3 through 6, which show various in-use views of the apparatus 10. FIG. 3 depicts an operator 11 utilizing the upper front handles 24, 34 to perform certain exercises. The operator 11 can do exercise such as, but not limited to: dips, support free squats, various stretches, or the like. The upper rear handles 25, 35 can also be utilized in a similar manner as the upper front handles 24, 34 to perform the above-mentioned exercises. FIG. 4 depicts the operator 11 utilizing the cross bar 55. The cross bar 55 is laid across and is supported by the upper rear handles 25, 35 or upper front handles 24, 34 to allow the operator 11 to perform certain exercise such as, but not limited to: pull-ups, chin-ups, or the like. FIG. 5 depicts the operator 11 utilizing the rear handle 52 to perform certain exercises. The rear handle 52 is utilized for exercises such as, but not limited to: push-ups, close grip push-ups, frog kicks, scissor kicks, triceps dips, or the like. FIG. 6 depicts the operator 11 utilizing the front handles 23, 33. The front handles 23, 33 are utilized for the operator 11 to perform certain exercises such as, but not limited to: push-ups, leg raises, frog kicks, or the like.

It can be appreciated by one skilled in the art that other styles and configurations of the invention can be easily incorporated into the teachings of the present disclosure and only one particular configuration has been shown and described for purposes of clarity and disclosure and not by way of limitation of scope.

In accordance with the invention, the preferred embodiment can be utilized by the user in a simple and effortless manner with little or no training. After initial purchase or acquisition of the apparatus 10, it is installed and utilized as indicated in FIGS. 1 through 4.

The method of installing the apparatus 10 can be achieved by performing a series of steps. It can be appreciated that the steps described can be performed in alternative order and as such should not be viewed as a limiting factor. Acquiring the apparatus 10. Positioning the base members 21, 31 on a generally level surface with each upright 22, 32 in an upright vertical orientation. Mating each interlocking member 51 into a respective receiving slot 27, 37. Inserting fasteners 42 into each aperture 41 upon each mounting ear 40. Positioning the mat 60 into a desired position. Positioning the cross bar 55 upon the respective upper handles, 24, 25, 34, 35 and engaging the protective collars 26, 36 over the first and second upright 22, 32. Utilizing the handles 23, 24, 25, 33, 34, 35, 52 as desired to perform selected certain exercises. Enabling operators 11 the capability to perform total body exercises at virtually any location in a manner which is quick, easy, and effective while being performed with a minimal amount of equipment.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. An exercise apparatus comprising:

a first frame comprising a generally rectangular first base adapted to lay flat on a floor surface, a generally "L"- shaped first upright affixed to a top surface of said first base, a first lower front handle affixed between said top surface of said first base and a lower end of said first upright, a first upper front handle affixed to a side of an upper end of said first upright, and a first upper rear handle affixed to an opposing side of said upper end of said first upright;

a second frame comprising a generally rectangular second base adapted to lay flat on said floor surface, a generally "L"-shaped second upright affixed to a top surface of said second base, a second lower front handle affixed between said top surface of said second base and a lower end of said second upright, a second upper front handle affixed to a side of an upper end of said second upright, and a second upper rear handle affixed to an opposing side of said upper end of said second upright;

a rectangular rear base adapted to lay flat on said floor surface and attachable between said first frame and said second frame such that said first frame is spaced apart from and is parallel to said second frame defining an open area, said rear base comprising a rear handle affixed to a top surface; and, a cross bar supported horizontally between said upper end of said first upright and said upper end of said second upright;

wherein said cross bar extends between and is either supported by said first upper front handle and said second upper front handle, or supported by said first upper rear handle and said second upper rear handle.

2. The apparatus of claim 1, wherein said first base further comprises a first receiving slot disposed on an end portion;

said second base further comprises a second receiving slot disposed on an end portion; and, said rear base further comprises an interlocking member disposed on each end for engagingly mating with said first receiving slot and said second receiving slot.

3. The apparatus of claim 2, wherein said cross bar further comprises a first protective collar affixed an end portion and a second protective collar affixed to an opposing end portion;

wherein said first collar further comprises a size and shape suitable for receiving said upper end of said first upright and said second collar further comprises a size and shape suitable for receiving said upper end of said second upright.

4. The apparatus of claim 3, wherein said first upright is disposed on an end portion of said first base opposite said first receiving slot; and, said second upright is disposed on an end portion of said second base opposite said second receiving slot.

5. The apparatus of claim 4, wherein said first base and said second base each further comprises a pair of mounting ears disposed on opposing ends;

wherein each of said mounting ears further comprises an aperture for rigidly fastening said first base and said second base to said floor surface.

6. The apparatus of claim 5, further comprising a cushioned mat adapted to lay flat on said floor surface and positionable within said open area between said first frame and said second frame.

7. The apparatus of claim 5, wherein said first upper front handle and said second upper front handle are parallel to one another.

8. The apparatus of claim 5, wherein said first upper rear handle and said second upper rear handle are parallel to one another.

9. The apparatus of claim 5, wherein said first lower handle and said second lower handle are parallel to one another.

10. The apparatus of claim 1, further comprising a cushioned mat adapted to lay flat on said floor surface and positionable within said open area between said first frame and said second frame.

11. The apparatus of claim 1, wherein said cross bar further comprises a first protective collar affixed an end portion and a second protective collar affixed to an opposing end portion;

wherein said first collar further comprises a size and shape suitable for receiving said upper end of said first upright and said second collar further comprises a size and shape suitable for receiving said upper end of said second upright.

* * * * *